United States Patent [19]

Hewison

[11] Patent Number: 4,881,861

[45] Date of Patent: Nov. 21, 1989

[54] FASTENING ASSEMBLY

[75] Inventor: George D. Hewison, Aldershot, Hants, Great Britain

[73] Assignee: ITW Limited, England

[21] Appl. No.: 236,532

[22] Filed: Aug. 25, 1988

[30] Foreign Application Priority Data

Sep. 8, 1987 [GB] United Kingdom ..... 8721049

[51] Int. Cl.[4] ..... F16B 35/02

[52] U.S. Cl. ..... 411/383; 411/387; 411/396; 52/410

[58] Field of Search ..... 411/383, 384, 387, 396, 411/412, 413, 401, 531; 52/410, 512

[56] References Cited

U.S. PATENT DOCUMENTS

| | | | |
|---|---|---|---|
| 3,478,639 | 11/1969 | Gruca | 411/387 |
| 4,380,413 | 4/1983 | Dewey | 411/431 |
| 4,453,361 | 6/1984 | Hu7lsey | 52/410 |
| 4,763,456 | 8/1988 | Giannuzzi | 52/410 |
| 4,780,039 | 10/1988 | Hartman | 411/531 |

*Primary Examiner*—Neill R. Wilson

*Attorney, Agent, or Firm*—Thomas W. Buckman; Neal C. Johnson

[57] ABSTRACT

A fastening assembly (1) for fastening a waterproof membrane and thick insulation to a roof deck comprises a screw threaded fastener (2) having a driving head (9), a clamp plate (5) for spreading the clamping load of the fastening assembly over an area of the surface of the waterproof membrane, a clamp tube (4) having a head (19& ) and a foot (18). The food (18) is arranged to be engaged and held by the head (19) is arranged to engage and hold the clamp plate (5). An expanding auger (3) is formed between a screw thread (7) of the fastener (2) and the foot (18& ) of the clamp tube (4) In use, the auger (3) rotates with the fastener to expand the hole in the waterproof membrane through which the fastener (2) is inserted so that it accommodates the clamp tube (4) of the fastening assembly (1).

10 Claims, 2 Drawing Sheets

FASTENING ASSEMBLY

It is becoming increasingly common to form roofs by providing a metal roof deck supported on rafters or purlins, covering this roof deck by a thick layer of insulation, typically between 100 mms and 330 mms thick and then covering this by a tough waterproof membrane. When the waterproof membrane is formed by a single sheet of material this is usually reinforced with fibres to increase its toughness. Conventionally such membranes and insulation material are fixed to the roof deck via a regularly fastening spaced array of fastening assemblies comprising clamp plates which overlie the waterproof membrane and which are fixed to the roof deck by long screw threaded fasteners. It is known for the clamp plates to be injection moulded from plastics material and to include an integrally moulded pointed and downwardly projecting tubular neck. The pointed neck pierces the membrane and reduces the length of screw threaded fastener that is required but with increasing toughness of membrane it is difficult for the necks of such clamp plates to penetrate it.

Another application is where an existing roof is being upgraded to improve its insulation by providing a thick insulation on top of the existing roof structure and then covering this with a waterproof membrane. In this case it is necessary for the fastening assemblies to pierce an existing roof covering which may include three layers of bituminous felt.

According to this invention a fastening assembly for fastening a waterproof membrane and thick insulation to a roof deck comprises a screw threaded fastener having a driving head, a clamp plate for spreading the clamping load of the fastening assembly over an area of the surface of the waterproof membrane, a clamp tube having a head and a foot, the foot being arranged to be engaged and held by the head of the screw threaded fastener and the head being arranged to engage and hold the clamp plate, and an expanding auger formed between the screw thread of the fastener and the foot of the clamp tube, in use, the auger rotating with the fastener to expand the hole in the waterproof membrane through which the fastener is inserted so that it accommodates the clamp tube of the fastening assembly.

The expanding auger may be integral with the screw threaded fastener and, in this case it is provided adjacent the driving head of the screw threaded fastener. Alternatively the expanding auger may be integral with the clamp tube and be provided at the leading end of the clamp tube. In this case, it is preferred that the foot of the clamp tube includes a cooperating formation which cooperates with the head of the fastener to prevent relative rotation between the fastener and the clamp tube so that, rotation of the fastener via its driving head, in turn rotates the clamp tube and, with it, the expanding auger as the fastener is driven into the roof deck. Preferably however the expanding auger is provided as an independent integer separate from both the fastener and the clamp tube. In this case, it is preferred that the auger has a non-circular cross-section and the fastener has a corresponding non-circular cross-section so that the auger rotates with the fastener as it is driven. Preferably the auger includes internal driving abutments and the fastener includes projections forged in its shank adjacent its head which, in use, cooperate with the driving abutments of the auger to rotate the auger.

Even when a separate auger is provided it is still preferred that the foot of the clamp tube is arranged to engage the outer profile of the driving head of the screw threaded fastener at least to prevent the driving head of the screw rotating with respect to the clamp tube in the unscrewing direction of the fastener. This prevents the fastener assembly from unwinding as a result of wind vibration conditions on the membrane. Preferably the engagement has the form of a one-way clutch so that the entire fastening assembly does not rotate as the fastener is driven into the roof decking, only the fastener and the auger.

The head of the clamp tube preferably has a non-circular cross-section which corresponds to that of a central aperture of the clamping plate. Typically the aperture is square or hexagonal and the head of the clamp tube includes an outwardly projecting lip which prevents the head of the clamp tube passing through the aperture in the clamp plate. Preferably the head of the clamp tube also includes resilient detents which engage the undersurface of the clamp plate around its central aperture to hold the clamp plate in position at the head of the clamp tube so that, after installation, the clamp plate does not move downwards with respect to the clamp tube as a result of, for example, roof traffic.

Preferably the screw threaded fastener is able to penetrate a roof deck without needing a pre-drilled hole. With a thin roof deck it is possible to use a gimlet point screw but preferably the fastener includes a drilling point and a self-tapping screw thread. It is further preferred that the screw thread of the fastener is of the buttress thread type so that it has the maximum pull-out resistance for its diameter. Prefeably the driving head of the screw threaded fastener is hexagonal in cross-section and also includes a driving recess to enable it to be driven by a corresponding driver inserted through the central aperture of the clamp plate and through the clamp tube.

A particular example of a fastening assembly in accordance with this invention will now be described with reference to the accompanying drawings, in which.

Figure 1:
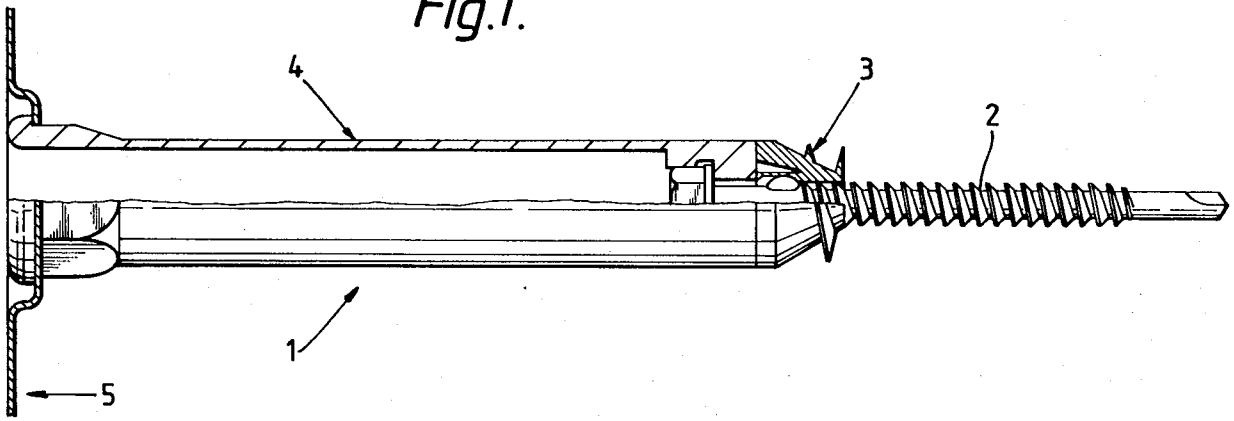
FIG. 1 is a partially sectioned side elevation of the complete assembly.
Figure 2:
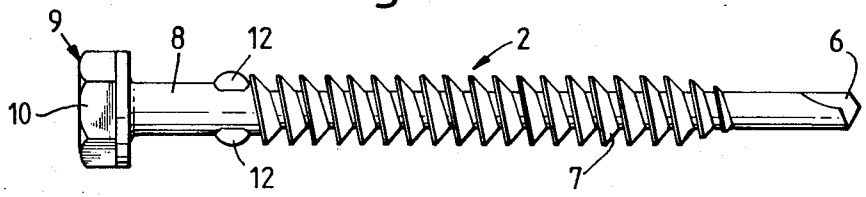
FIG. 2 is a side elevation of the screw threaded fastener.
Figure 3:
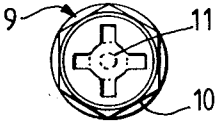
FIG. 3 is an end elevation of the head of the fastener.
Figure 4:
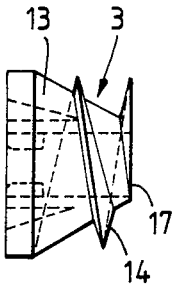
FIG. 4 is a side elevation of the expanding auger.
Figure 5:
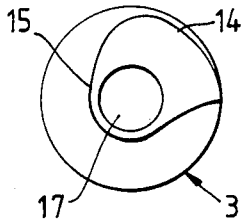
FIG. 5 is an elevation of the leading end of the expanding auger.
Figure 6:
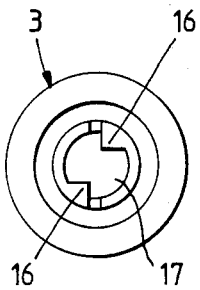
FIG. 6 is an elevation of the trailing end of the expanding auger.
Figure 7:
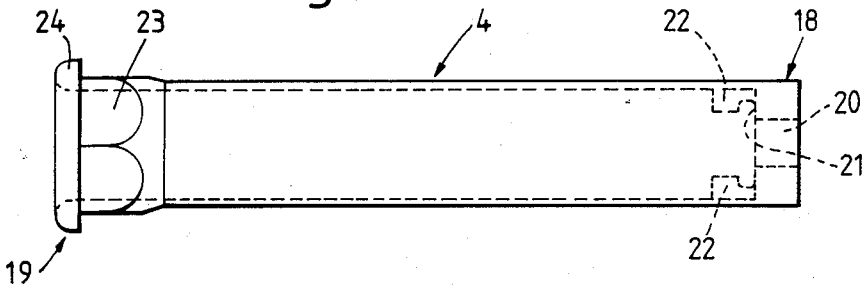
FIG. 7 is a side elevation of the clamp tube.
Figure 8:
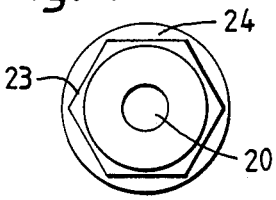
FIG. 8 is an end elevation of the leading end of the clamp tube.
Figure 9:
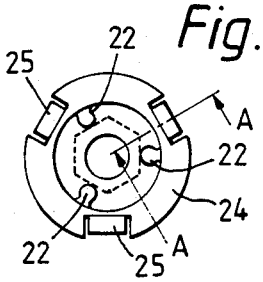
FIG. 9 is an end elevation of the trailing end of the clamp tube.

The fastening assembly 1 comprises a screw threaded fastener 2 and expanding auger 3, a clamp tube 4 and a clamp plate 5. The screw threaded fastener 2 has a drilling point 6, self tapping buttress screw thread 7, an unthreaded portion 8 and a head 9 which has a hexagonal outer cross-section 10 and an internal Phillips type driving recess 11. Projecting wings 12 are forged onto the unthreaded portion 8 of the shank of the fastener 2.

Figure 10:
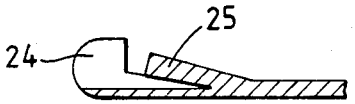
FIG. 10 is a radial section through the head of the clamp tube taken along the radius A shown in FIG. 9.

The expanding auger comprises a generally frusto-conical body 13 having a smallest diameter substantially the same as that of the screw thread 7 of the fastener 2 and a large diameter similar to that of the clamp tube 4. Two turns of a tapered screw thread 14 having a quarter turn start 15 are formed around the outside of the frusto-conical body 13. A pair of driving abutments 16 project inwards into an axial aperture 17 through the expanding auger and engage the forged projecting wings 12 on the shank of the screw 2. The expanding auger is typically moulded from plastics material such as nylon 6. The clamp tube 4 includes a foot 18 and a head 19. The foot 18 includes an aperture 20 to accommodate the shank of the screw threaded fastener 2 and a surrounding annular shoulder 21 which is engaged by the underside of the head 9 of the screw threaded fastener 2. Three lobes 22 project inwards into the clamp tube to engage the flats of the hexagonal portion 10 of the fastener 2 and prevent the tube 4 from rotating with respect to the fastener 2. The head 19 includes hexagonal flats 23 and a projecting lip 24. Springy tongues 25 project outwards from three equi-angularly spaced hexagonal flats 23 as shown most clearly in FIG. 10. Preferably the clamping tube is made from resilient plastics material such as nylon 6 which is sufficiently robust to resist creep in use.

The clamp plate 5 is one of various conventional types and includes an hexagonal central aperture of size corresponding to that defined by the hexagonal flats 23 at the head 19 of the clamp tube 4. As the clamp tube 4 is threaded through the central aperture in the clamp plate 5 the springy tongues 25 flex inwards until the clamp plate surrounding the central aperture is against the projecting lip 24 whereupon the springy tongues 25 spring outwards to engage the undersurface of the clamp plate 5.

By using three sizes of screw threaded fastener 2 having lengths of 100, 80 and 60 mm respectively and four different lengths of clamp tube 4 of 275, 215, 155, and 95 mm, respectively, it is possible to assemble fastening assemblies that are adapted to fix roofing thicknesses ranging from a minimum of 100 mm to a maximum of 340 mm.

I claim:

1. A fastening assembly for fastening a waterproof membrane and thick insulation to a roof deck, said fastening assembly comprising a screw threaded fastener, a driving head located at one end of said screw threaded fastener, a screw thread located on said screw threaded fastener, a clamp plate for spreading a clamping load of said. fastening assembly over an area of said waterproof membrane, a clamp tube having a head and a foot, said foot of said clamp tube being arranged to be engaged and held by said head of said screw threaded fastener and said head of said clamp tube being arranged to engage and hold said clamp plate, and an expanding auger, said expanding auger being formed between said screw thread of said screw threaded fastener and said foot of said clamp tube, in use, said auger rotating with said fastener to expand a hole in said waterproof membrane through which said fastener is inserted whereby said hole accommodates said clamp tube of said fastening assembly.

2. The fastening assembly of claim 1, wherein said expanding auger is provided as an independent integer separate from both said fastener and said clamp tube and wherein said auger has a non-circular cross-section and said fastener has a corresponding non-circular cross-section whereby said auger rotates with said fastener as said fastener is driven.

3. The fastening assembly of claim 2, wherein said screw threaded.fastener includes a shank, and projections forged in said shank adjacent its head, and wherein said auger includes internal driving abutments, said projections in use, cooperating with said driving abutments on said auger to rotates said auger.

4. The fastening assembly of claim 1, wherein said foot of said clamp tube is adapted to engage an outer profile of said driving head of said screw threaded fastener at least to prevent said driving head of said screw threaded fastener rotating with respect to said clamp tube in an unscrewing direction of said screw threaded fastener.

5. The fastening assembly of claim 1, wherein said head of said clamp tube has a non-circular cross-section which corresponds to that of a central aperture of said clamp plate.

6. The fastening assembly of claim 1, wherein said head of said clamp tube includes resilient detents, said resilient detents engaging an undersurface of said clamp plate around its central aperture to hold said clamp plate in position at said head of said clamp tube.

7. The fastening assembly of claim 1, wherein said screw threaded fastener is adapted to penetrate said roof deck without needing a pre-drilled hole.

8. The fastening assembly of claim 7, wherein said screw threaded fastener includes a drilling point and a self-tapping screw thread.

9. The fastening assembly of claim 1, wherein said screw thread of said screw threaded fastener is of the buttress thread type whereby it has the maximum pull-out resistance for its diameter.

10. The fastening assembly of claim 1, wherein said driving head of said screw threaded fastener is hexagonal in cross-section and also includes a driving recess to enable it to be driven by a corresponding driver inserted through said central aperture of said clamp plate and through said clamp tube.

* * * * *